US011655521B2

(12) United States Patent
Tseng et al.

(10) Patent No.: US 11,655,521 B2
(45) Date of Patent: May 23, 2023

(54) GRAPHENE MODIFYING METHOD OF METAL

(71) Applicant: Amazing Cool Technology Corp, Taipei (TW)

(72) Inventors: Wei-Lin Tseng, Taipei (TW); Yang-Ming Shih, Taipei (TW); Chi-Hang Hung, Taipei (TW)

(73) Assignee: Amazing Cool Technology Corp, Taipei (TW)

( * ) Notice: Subject to any disclaimer, the term of this patent is extended or adjusted under 35 U.S.C. 154(b) by 147 days.

(21) Appl. No.: 16/832,382

(22) Filed: Mar. 27, 2020

(65) Prior Publication Data

US 2021/0299746 A1 Sep. 30, 2021

(51) Int. Cl.
*B22F 3/10* (2006.01)
*B22F 1/142* (2022.01)
(Continued)

(52) U.S. Cl.
CPC ..... *C22C 1/05* (2013.01); *B22F 1/103* (2022.01); *B22F 1/142* (2022.01); *B22F 3/1007* (2013.01);
(Continued)

(58) Field of Classification Search
CPC ..... B22F 1/142; B22F 3/1007; B22F 3/1021; B22F 3/225; B22F 2302/40
See application file for complete search history.

(56) References Cited

U.S. PATENT DOCUMENTS 5,366,688 A * 11/1994 Terpstra ..... H01L 21/4871 419/36
2010/0183471 A1* 7/2010 Liu ..... B22F 3/1007 419/37
(Continued)

FOREIGN PATENT DOCUMENTS

CN 104326747 B * 6/2018
CN 106623890 B * 2/2019 ..... B22F 1/0059

OTHER PUBLICATIONS

Chen, Yakun, et al. "Fabrication of in-situ grown graphene reinforced Cu matrix composites." Scientific reports 6.1 (2016): 1-9. (Year: 2016).*
(Continued)

*Primary Examiner* — Anthony J Zimmer
*Assistant Examiner* — Sean P. O'Keefe
(74) *Attorney, Agent, or Firm* — Bayramoglu Law Offices LLC

(57) ABSTRACT

A graphene modifying method of metal having following steps of providing metal powders, graphene powders and a binder, the metal powder has metal particles, and the graphene powder has graphene micro pieces, each graphene micro piece is formed by 6-atom unit cells connected with each other, each 6-atom unit cell is connected to a stearic acid functional group by a sp3 bond; mixing the metal powder, the graphene powder, and the binder to generate heat by a friction, each sp3 bond connected with the stearic acid functional group is thereby heated and broken, each 6-atom unit cell is connected with other 6-atom unit cells via the broken sp3 bond, and the metal particles are thereby wrapped by the 6-atom unit cells; and sintering the metal particles into a metal body to transform the plurality of graphene micro pieces into a three-dimensional mash embedded in the metal body.

6 Claims, 4 Drawing Sheets

(51) Int. Cl.

| | |
|---|---|
| ***B22F 1/103*** | (2022.01) |
| ***B22F 1/145*** | (2022.01) |
| ***C22C 1/05*** | (2023.01) |

(52) U.S. Cl.

CPC ..... *B22F 3/1021* (2013.01); *B22F 3/1035* (2013.01); *B22F 1/145* (2022.01); *B22F 1/147* (2022.01); *B22F 2301/10* (2013.01); *B22F 2302/40* (2013.01)

(56) References Cited

U.S. PATENT DOCUMENTS

| | | | | |
|---|---|---|---|---|
| 2020/0009653 | A1* | 1/2020 | Tseng | B22F 1/10 |
| 2020/0047254 | A1* | 2/2020 | Bao | B22F 3/24 |
| 2022/0003290 | A1* | 1/2022 | Nihei | C04B 35/62625 |

OTHER PUBLICATIONS

Hidalgo-Manrique, Paloma, et al. "Copper/graphene composites: a review." Journal of materials science 54.19 (2019): 12236-12289 (Year: 2019).*

* cited by examiner

GRAPHENE MODIFYING METHOD OF METAL

BACKGROUND OF THE INVENTION

Field of the Invention

The present invention relates to a graphene metal composite material, especially to a graphene modifying method of metal which enables graphene to be evenly distributed in a metal.

Description of Related Art

At present, the manufacturing procedure and application of utilizing silicon carbide or aluminum oxide to reinforce the copper-based composite material have been well developed, but the performance and the actual requirement cannot be really satisfied by skilled people in the art. However, graphene has excellent mechanical performance, thermal performance and electric performance, and could be an ideal reinforcing member for manufacturing a heat conducting composite material. Researches of utilizing graphene to reinforce the aluminum-based or copper-based composite material are still in an early stage, which still need to be developed. As such, how to evenly distribute the graphene in the copper-based or aluminum-based member and form an excellent contact interface between graphene and metal shall be the key issues in researches.

Moreover, in the existing technology, an adhering agent is added in an organic material to increase the material viscosity for fixing different organic materials; a liquid-state inorganic material is mostly in an ion status and provided with broken bonding, so that a diffusing agent is added, and the inorganic material is fixed via the binding. However, the properties of the organic material and the inorganic are distinctively different, and currently there is no proper fixing method between the organic material and the inorganic material. As such, the organic graphene and the inorganic metal cannot be easily and evenly combined.

Accordingly, the applicant of the present invention has devoted himself for improving the mentioned disadvantages.

SUMMARY OF THE INVENTION

The present invention is to provide a graphene modifying method of metal which enables graphene to be evenly dispersed in a metal.

Accordingly, the present invention provides a graphene modifying method of metal, which includes steps of: providing a metal powder, a graphene powder, and a binder, the metal powder has a plurality of metal particles, the binder has a wax material, the graphene powder has a plurality of graphene micro pieces, each graphene micro piece is formed by 6-atom unit cells connected with each other, each 6-atom unit cell has six carbon atoms connected in a hexagonal structure, one of the carbon atoms of each 6-atom unit cell is connected with a stearic acid functional group via a sp3 bond, the binder has a coupling agent with 0.5~2% in weight and a dispersing agent with 5~20% in weight, the coupling agent is selected from one of titanate or chromium complex, and the dispersing agent is selected from a group consisting of methylpentanol, polyacrylamide, and fatty acid polyethylene glycol ester; mixing the metal powder, the graphene powder, and the binder to form a powder material for generating heat by a friction, wherein each sp3 bond connected with the stearic acid functional group is thereby heated and broken, after the stearic acid functional group is separate from each 6-atom unit cell, each 6-atom unit cell is connected with other 6-atom unit cells via the broken sp3 bond, and the metal particles are thereby wrapped by the 6-atom unit cells; and sintering the metal particles into a metal body to transform the plurality of graphene micro pieces into a three-dimensional mash embedded in the metal body.

According to the graphene modifying method provided by the present invention, a green part includes the metal particles and the graphene micro pieces which are evenly mixed, and each of the graphene micro pieces is wrapped by the solid-state binder and adhered with the metal particles.

According to the graphene modifying method provided by the present invention, further includes steps of: heating the powder material for being in a melted status so as to form a liquid-state mixing material, wherein the liquid-state mixing material includes the metal powder, the liquid-state binder and the graphene powder; filling the liquid-state mixing material in a mold for being injection molded and solidified to form a green part; and removing the binder in the green part to form a brown part, wherein firstly a watery/solvent debinding operation is processed to the green part for removing a part of the binder, so that a slit is formed in the brown part and a thermal debinding operation is processed, a temperature of the thermal debinding operation is between 140~170 degrees Celsius, wherein the brown part is sintered for enabling the metal particles to be melted for forming a metal body.

According to the graphene modifying method provided by the present invention, a nitrogen or hydrogen burning operation is used for sintering the brown part.

According to the graphene modifying method provided by the present invention, the watery/solvent debinding operation is to immerse the green part in a solvent for solving the binder, and the thermal debinding operation is to process a thermal treatment to the green part for vaporizing the binder.

According to the graphene modifying method provided by the present invention, a vacuum thermo press sintering operation is used for sintering the metal particles.

According to the graphene modifying method provided by the present invention, the metal body is aluminum or copper.

According to the graphene modifying method provided by the present invention, each metal particle is a dendritic electrolytic copper particle, the power material is formed through a planetary stirring and mixing operation, and a weight percentage of the graphene powder in the powder material is smaller than 5%.

Based on what has been disclosed above, the graphene modifying method of metal is to provide the graphene powder when the metal powder is mixed with the binder, a mixture of the metal, the graphene, and the binder is formed after the mixing and granulating process, and after the ejection molding and debinding processes, the metal powder and the grapheme can be combined in the sintering step, thereby increasing the thermal conductivity.

DETAILED DESCRIPTION OF THE INVENTION

A preferred embodiment of the present invention will be described with reference to the drawings.

Figure 7:
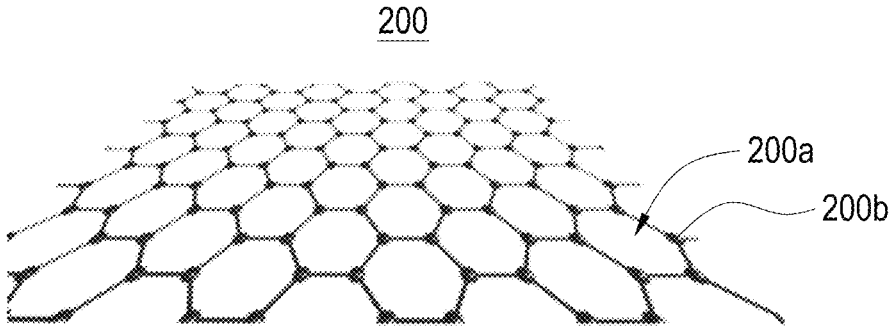
FIG. 7 is a schematic showing the graphene.
Figure 8:
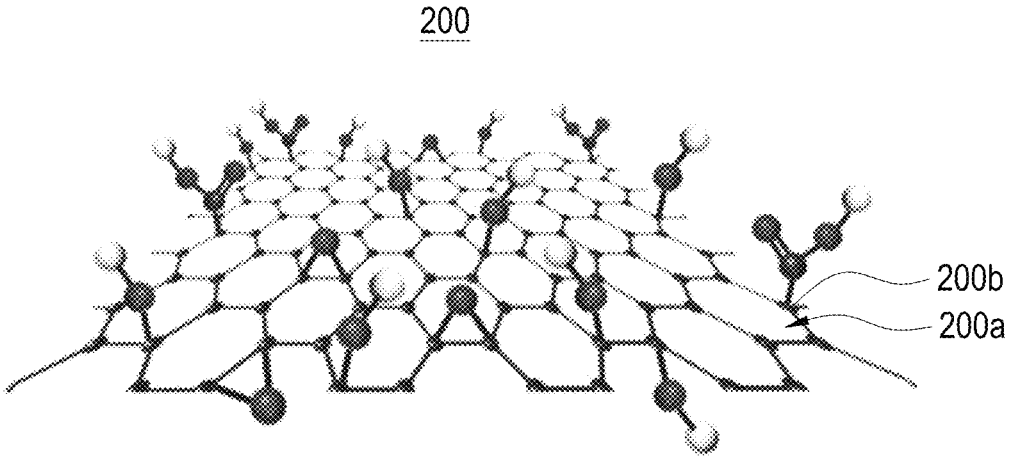
FIG. 8 is a schematic showing the functioned graphene.

Please refer from FIG. 1 to FIG. 6. A graphene metal composite material and a manufacturing method thereof are provided according to a preferred embodiment of the present invention. According to this embodiment, a graphene modifying method of metal includes following steps:

In a step a) providing a metal powder, a graphene powder, and a binder 300, wherein the metal powder is aluminum powder or copper powder. The metal powder has a plurality of metal particles 100 (aluminum particles or copper particles, and the copper particles are preferably to be dendritic electrolytic copper particles), the graphene powder has a plurality of graphene micro pieces 200, and each graphene micro piece 200 is formed by a plurality of 6-atom unit cells connected with each other, as shown in FIG. 7. Please refer to FIG. 1, FIG. 7 and FIG. 8. The graphene micro piece (as shown in FIG. 7) is modified to be connected with a functional group thereby being formed as a functioned graphene (as shown in FIG. 8). According to this embodiment, the functional group is preferably to be an oxygen functional group, for example a stearic acid functional group, the oxygen functional group is bonded to one of carbon atoms of the graphene via a sp3 bond. Each 6-atom unit cell has six carbon atoms connected in a hexagonal structure, as shown in FIG. 8, one of the carbon atoms of each 6-atom unit cell is connected with a functional group via the sp3 bond. The binder 300 is mainly made of a wax material including a paraffin wax, micro-crystal wax or acrylic wax, and composed of a thermoplastic polymer having low molecular weight or an oil material. The binder 300 includes a coupling agent having titanate or chromium complex with 0.5~2% in weight and serving as a fixing material. The binder 300 includes a dispersing agent with 5~20% in weight and serving to evenly dispersing materials, and the dispersing agent can be methylpentanol, polyacrylamide, or fatty acid polyethylene glycol ester.

In a step b) mixing and granulating the metal powder, the graphene powder, and the binder 300 provided in the step a) for forming a powder material 10. The means of mixing and granulating is to evenly mix the metal powder, the graphene powder, and the binder 300, so that the metal particles 100 and the graphene micro pieces 200 in the powder material 10 is able to be dispersed in the dispersing agent so as to be respectively wrapped by the binder 300. Substantially speaking, the specific gravity differences between the graphene and the metal is very large, a planetary stirring and mixing means has to be adopted and stirring in different directions is required for allowing the graphene micro pieces 200 to be evenly dispersed in the powder material 10. Moreover, the weight percentage of the graphene powder in the powder material 10 is preferably smaller than 5% for being avoided from gathering with each other. In the step) b, the functioned graphene can increase the dispersing property of the graphene micro pieces 200 in the metal powder and the binder 300. Because a certain amount of the functional groups enter the graphene micro pieces 200, the graphene micro pieces 200 are provided with the same electric charge, when the graphene micro pieces 200 are provided with the functional groups, a static repulsing force is generated between the same electric charges, so that the graphene micro pieces 200 are mutually repulsed and separated so as to be evenly dispersed in the dispersing agent and the binder 300. In the step b) of mixing and granulating, the functioned graphene micro pieces 200 generate heat by frictions, so that the sp3 bond of the oxygen functional group is heated and broken, and the oxygen functional group is separated. As such, the carbon atom connected with the oxygen functional group can be immediately re-bonded with the broken sp3 bond of the carbon atom of other graphene micro piece 200, thus the connection of the graphene micro pieces 200 is in a planar status and wraps each metal particle 100, thereby forming a spherical body.

According to the present invention, by adding the coupling agent in a mixture containing the graphene and the metal, the organic graphene and the inorganic metal can be assisted to be mutually bonded, and meanwhile the dispersing agent enables the graphene to be dispersed so as to be prevented from gathering with each other. Moreover, the inorganic material in the mixture is formed in an ionic status and provided with a bonding capability, the coupling agent can also assist the dispersing agent to disperse the inorganic material. The titanate or the organic chromium complex both have a property of strong bonding force of peripheral electrons, thus the connecting strength of the graphene and the metal can be enhanced; the titanate is provided with a property of light in mass, the organic chromium complex is provided with lateral chains for allowing more bonding to be formed. For corresponding to the graphene material having different states, different solid-state dispersing material added with the methylpentanol is adopted as the dispersing agent, a liquid-state material added with the polyacrylamide is adopted as the dispersing agent, and a gas-state material added with the fatty acid polyethylene glycol ester is adopted as the dispersing agent.

Figure 1:
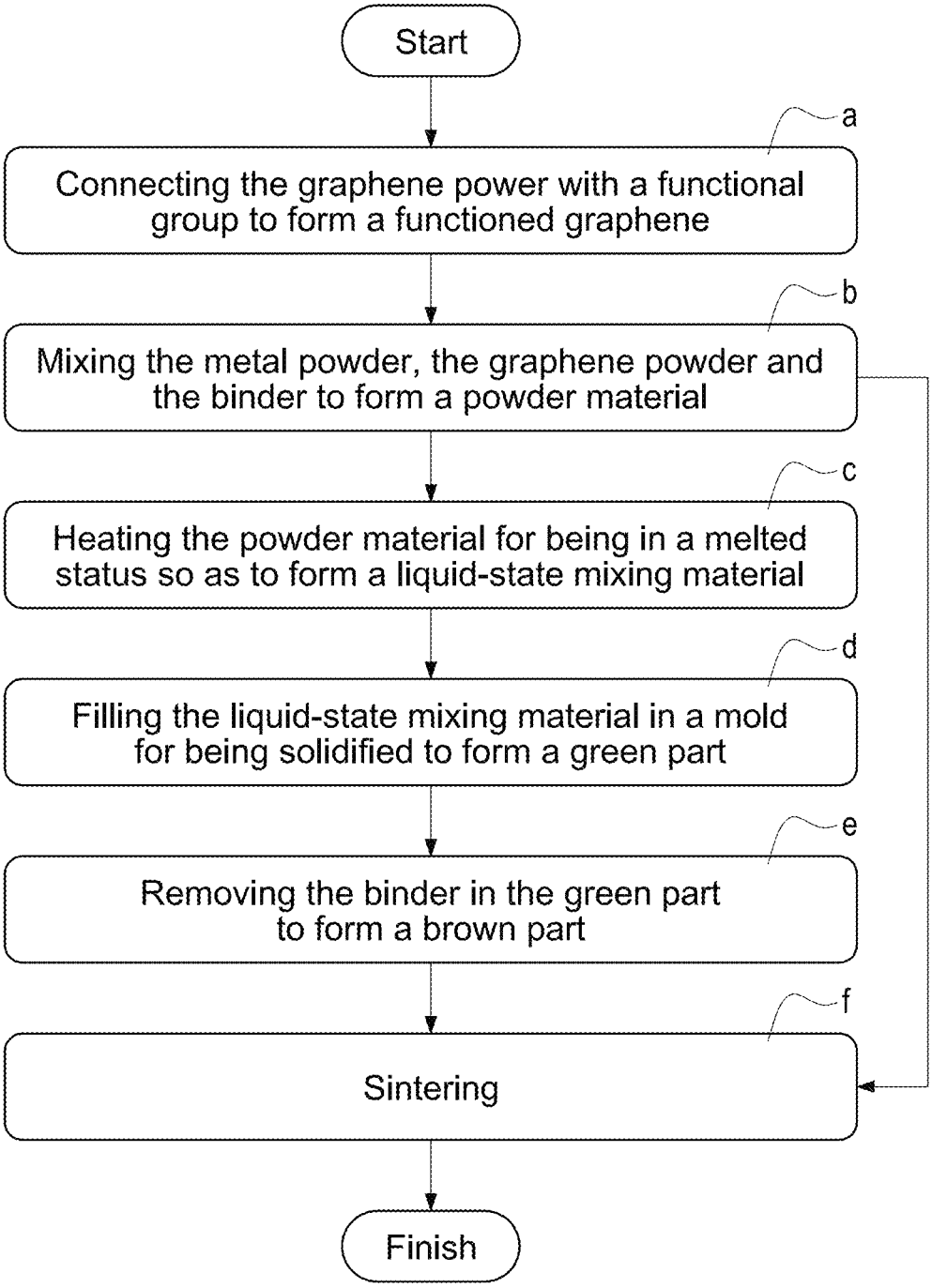
FIG. 1 is a flowchart showing a graphene modifying method of metal according to a preferred embodiment of the present invention.
Figure 2:
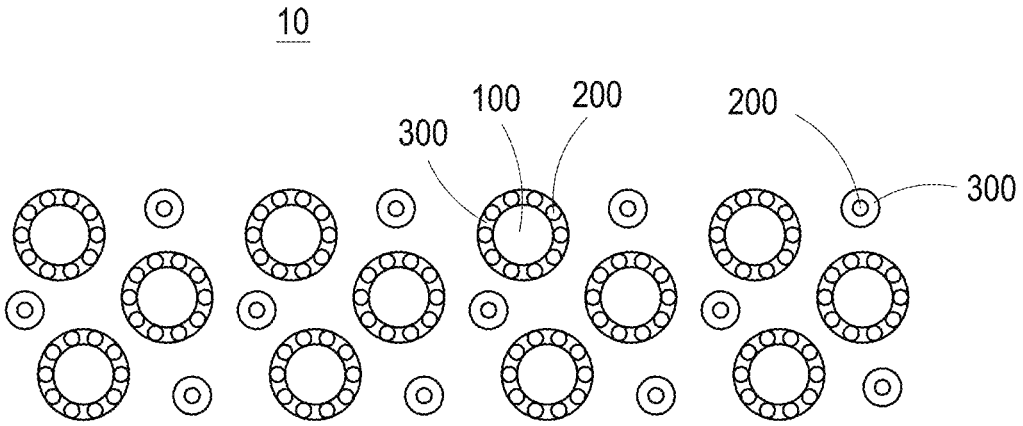
FIG. 2 is a schematic showing a powder material of the graphene modifying method of metal according to a preferred embodiment of the present invention.
Figure 3:
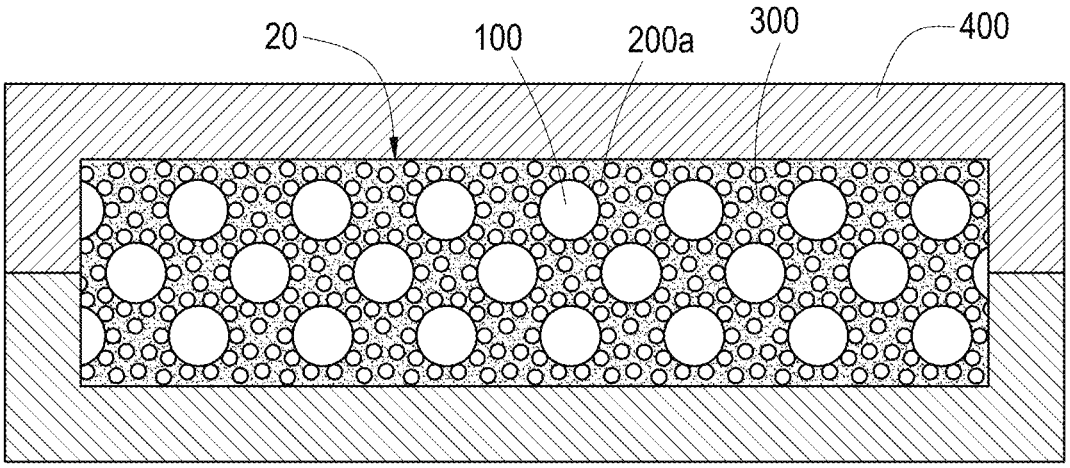
FIG. 3 is a schematic showing a step of injection molding of the graphene modifying method of metal according to a preferred embodiment of the present invention.

A vacuum thermo press sintering means can be used as a means for sintering the metal particles 100, the vacuum thermal press sintering means is processed in a step f) of sintering after the step b), as shown in FIG. 3, a liquid-state mixing material 20 is filled in a mold 400, the mold 400 is able to pressurize the liquid-state mixing material 20 and the liquid-state mixing material 20 is processed with a sintering operation in an environment of being in a vacuum status and 700 degrees Celsius, so that the aluminum or copper metal particles 100 can be sintered. Because the mold 400 pressurizes the liquid-state mixing material 20, the density of the liquid-state mixing material 20 can be increased for allowing the sintering operation to be processed in a lower temperature.

The vacuum thermo press sintering means to sinter the metal particles 100 is able to melt the metal particles 100 so as to be connected with each other to form a metal body 100*a* and the binder 300 can be vaporized and discharged; because the graphene micro pieces 200 do not melt and the boiling point thereof is much higher than the metal particles 100 and the binder 300, so that the structure thereof is not damaged during the thermal treatment, and the graphene micro pieces 200 can be evenly dispersed in the metal body 100*a*.

A cold press sintering means can also be adopted for sintering the metal particles 100, which includes a cold press forming (step c) to step e) and the step f) of sintering, and the cold press step includes following two steps.

In a step c), processed after the step b), heating the powder material 10 to melt into the liquid-state mixing material 20; the liquid-state mixing material 20 includes the metal powder, the liquid-state binder 300, and the graphene powder.

Figure 4:
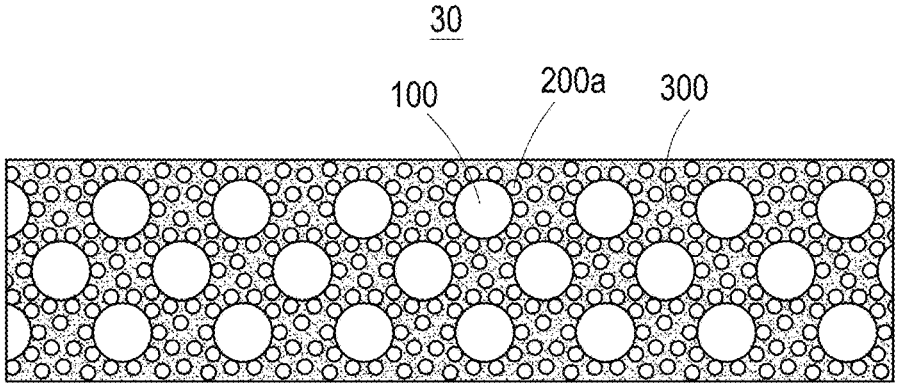
FIG. 4 is a schematic showing a green part of the graphene modifying method of metal according to a preferred embodiment of the present invention.

In a step d), processed after the step c) and as shown in FIG. 3, filling the liquid-state mixing material 20 in the mold 400 and processing a cold press forming means to solidify for forming a green part 30 as shown in FIG. 4; the green part 30 includes the metal particles 100 and the graphene micro pieces 200 which are evenly mixed, each graphene micro piece 200 is wrapped by the solid-state binder 300 and adhered with the metal particles 100.

Figure 5:
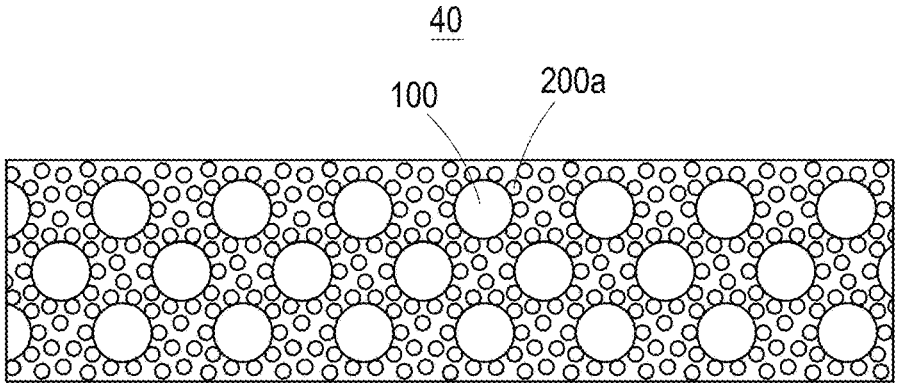
FIG. 5 is a schematic showing a brown part of the graphene modifying method of metal according to a preferred embodiment of the present invention.

As shown in FIG. 5, in a step e), processed after the step d) processing a debinding treatment to the green part 30 to remove the binder 300 in the green part 30 so as to form a brown part 40. The debinding means can be a thermal debinding means, or a watery/solvent debinding means. The thermal debinding means is to perform a thermal treatment to the green part 30, inert gas is adopted as a flow media, and a heating operation is processed to crack and vaporize the binder 300 so as to be discharged via the media. A vacuum debinding means is to utilize high temperature and high vacuum to vaporize the binder 300, and be discharged via distilled molecules. The watery/solvent debinding means is to solve the binder 300 via a solvent. Wherein, the thermal debinding means and the watery/solvent debinding means can be processed at the same time, firstly the green part 30 is processed with the watery/solvent debinding means to discharge a part of the binder 300, so that a slit is formed in the brown part 40 and the thermal debinding means is processed, thus high temperature gas can pass the slit to decompose and discharge the residual binder 300. In the step e), the temperature of the thermal debinding means is lower than the melting point of the metal particles 100 and higher than the melting point or the boiling point of the binder 300, and the working environment is heated to 140~170 degrees Celsius, because the graphene micro pieces 200 do not melt and the boiling point thereof is much higher than the metal particles 100 and the binder 300, the structure thereof is prevented from being damaged during the thermal treatment.

In a step f), processed after the step e), processing a nitrogen or hydrogen burning operation to the brown part 40 for allowing the metal particles 100 to be melted and mutually combined as the metal body 100*a*; when the metal particles 100 are copper, the environmental working temperature is heated to 1,050 degrees Celsius and the sintering operation is processed for one hour; when the metal particles 100 are aluminum, the environmental working temperature is heated to 600 degrees Celsius and the sintering operation is processed for one hour. Because the graphene micro pieces 200 do not melt and the boiling point thereof is much higher than the metal particles 100 and the binder 300, the structure thereof is prevented from being damaged during the thermal treatment, and the graphene micro pieces 200 are evenly dispersed in the metal body 100*a*. The metal body 100*a* can be aluminum or copper. Accordingly, a finished product 50 of the graphene metal composite material as shown in FIG. 6 is manufactured.

Figure 6:
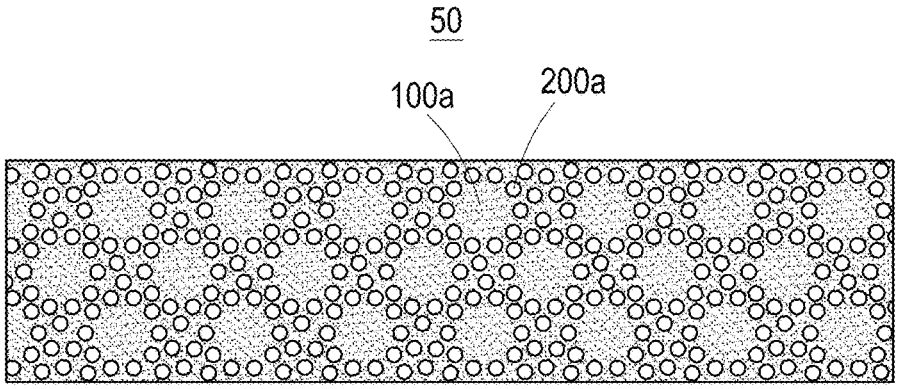
FIG. 6 is a schematic showing a graphene metal composite material of the graphene modifying method of metal according to a preferred embodiment of the present invention.

As shown in FIG. 6, with the above-mentioned manufacturing method to manufacture the finished product 50 of the graphene metal composite material, the graphene metal composite material of the present invention includes the metal body 100*a* and the plurality of graphene micro pieces 200 embedded in the metal body 100*a*. Wherein, the metal body 100*a* is aluminum or copper, and the graphene micro pieces 200 are evenly dispersed in the metal body 100*a*.

Based on what has been disclosed above, the graphene modifying method of metal is to provide the graphene powder when the metal powder is mixed with the binder 300, the mixture of the metal particles 100, the graphene micro pieces 200, and the binder 300 is formed after the mixing and granulating process, and after the ejection molding and debinding processes, in the sintering step, the graphene micro pieces 200 in the finished product 50 and wrapped by the metal particles 100 and arranged in the spherical means are connected and transformed to a three-dimensional status and combined in the metal body 100*a*, thereby increasing the thermal conductivity of the finished product 50. With the graphene increasing the thermal conductivity of a metal piece, comparing to a pure metal being served as a thermal conducting media and under a situation of having a same amount of thermal conduction, the present invention utilizes the graphene metal composite material having a smaller volume to serve as the thermal conducting media. Moreover, by adding the functional group, the graphene micro pieces 200 can be arranged in a more regular manner, thus the present invention is able to more evenly disperse comparing to the conventional dispersing structure, thereby being provided with a better thermal conducting effect.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A graphene modifying method of metal, including steps of:

a) providing a metal powder, a graphene powder, and a binder, wherein the metal powder comprising a plurality of metal particles, wherein each of the plurality of metal particles is a dendritic electrolytic copper particle and a weight percentage of the graphene powder in the powder material is less than 5%, the binder comprising a wax material, a coupling agent with 0.5%~2% in weight, and a dispersing agent with 5%~20% in weight, wherein the coupling agent is selected from one of titanate or chromium complex, and the dispersing agent is selected from a group consisting of methylpentanol, polyacrylamide, and fatty acid polyethylene glycol ester, the graphene powder comprising a plurality of graphene micro pieces, each of the plurality of graphene micro pieces is formed by 6-atom unit cells connected with each other, each of the 6-atom unit cells comprising six carbon atoms connected in a hexagonal structure, one of the six carbon atoms of each of the 6-atom unit cells is connected with a stearic acid functional group via a sp3 bond;

b) mixing the metal powder, the graphene powder, and the binder to form a powder material, wherein a heat is generated by a friction, the sp3 bond connected with the stearic acid functional group is thereby heated and broken, after the stearic acid functional group is separate from each of the 6-atom unit cells, each of the 6-atom unit cells is connected with other 6-atom unit cells via the sp3 bond, and the plurality of metal particles is thereby wrapped by 6-atom unit cells; and f) sintering the powder material formed in step (b) into a metal body with a vacuum thermo press sintering operation, wherein the plurality of metal particles is sintered into the metal body and the plurality of graphene micro pieces is transformed into a three-dimensional mash embedded in the metal body.

2. The graphene modifying method of metal according to claim 1, wherein the metal body is aluminum or copper.

3. The graphene modifying method of metal according to claim 1, wherein the powder material is formed through a planetary stirring and mixing operation.

4. The graphene modifying method of metal according to claim 1, wherein the powder mixture is in a liquid state mixing material.

5. The graphene modifying method of metal according to claim 4, wherein the liquid state mixing material is filled in a mold.

6. The graphene modifying method of metal according to claim 5, wherein the vacuum thermo press sintering operation is in a vacuum environment and 700 degrees C. with the mold pressurizing the liquid state mixing material thereby increasing the density of the liquid state mixing material.

* * * * *